US006613591B1

(12) United States Patent
Bhagavat et al.

(10) Patent No.: US 6,613,591 B1
(45) Date of Patent: Sep. 2, 2003

(54) METHOD OF ESTIMATING POST-POLISHING WAVINESS CHARACTERISTICS OF A SEMICONDUCTOR WAFER

(75) Inventors: Milind S. Bhagavat, St. Louis, MO (US); Yun-Biao Xin, Glastonbury, CT (US); Gary L. Anderson, St. Ann, MO (US); Brent F. Teasley, Silex, MO (US)

(73) Assignee: MEMC Electronic Materials, Inc., St. Peters, MO (US)

( * ) Notice: Subject to any disclaimer, the term of this patent is extended or adjusted under 35 U.S.C. 154(b) by 0 days.

(21) Appl. No.: 10/092,479

(22) Filed: Mar. 7, 2002

(51) Int. Cl.[7] ..... H01L 21/00

(52) U.S. Cl. ..... 438/14; 438/68; 438/113; 438/460

(58) Field of Search ..... 438/14, 15, 18, 438/51, 55, 64, 68, 106, 113, 459, 460

(56) References Cited

U.S. PATENT DOCUMENTS 5,376,890 A * 12/1994 Keevil et al. ..... 324/688

6,057,170 A * 5/2000 Witte ..... 438/14

FOREIGN PATENT DOCUMENTS

EP 971 399 A1 1/2000

* cited by examiner

*Primary Examiner*—David Nelms
*Assistant Examiner*—David Nhu
(74) *Attorney, Agent, or Firm*—Senniger, Powers, Leavitt & Roedel

(57) ABSTRACT

A method for estimating the likely waviness of a wafer after polishing based upon an accurate measurement of the waviness of the wafer in an as-cut condition, before polishing. The method measures the thickness profile of an upper and lower wafer surface to construct a median profile of the wafer in the direction of wiresaw cutting. The median surface is then passed through an appropriate Gaussian filter, such that the warp of the resulting profile estimates whether the wafer will exhibit unacceptable waviness in a post-polished stage.

14 Claims, 8 Drawing Sheets

METHOD OF ESTIMATING POST-POLISHING WAVINESS CHARACTERISTICS OF A SEMICONDUCTOR WAFER

BACKGROUND OF THE INVENTION

This invention relates to surface characteristics of semiconductor wafers, and more particularly to predicting the future waviness of a semiconductor wafer based upon its surface characteristics after cutting but before lapping and polishing.

Semiconductor wafers used as starting materials for the fabrication of integrated circuits must meet certain surface flatness and waviness requirements. Such wafers must be particularly flat and free of waviness for printing circuits on them by, for example, an electron beam-lithographic or photolithographic process. The quality of the wafer surface directly influences device line width capability, process latitude, yield and throughput. The continuing reduction in device geometry and increasingly stringent device fabrication specifications force manufacturers of semiconductor wafers to prepare increasingly flatter and defect free wafers.

Semiconductor wafers are generally prepared from a single crystal ingot cut, or sliced, into individual wafers. This cutting process may leave surface defects in the cut wafers, one of which is waviness, the focus of the present invention, as will be discussed in greater detail below. The slicing process and apparatus, and developments therein, are more fully described in the attached provisional application filed simultaneously by Milind Bhagavat, Dale A. Witte, Steven L. Kimbel, David Alan Sager and John Peyton entitled METHOD AND APPARATUS FOR SLICING SEMICONDUCTOR WAFERS. After cutting, the wafers are subjected to several processing operations to reduce the thickness of the wafer, remove damage caused by the cutting operation, and create a highly reflective surface. In conventional wafer shaping processes, a lapping operation is performed on the front and back surfaces of the wafer using an abrasive slurry and a set of rotating lapping plates. The lapping operation reduces the thickness of the wafer to remove surface damage induced by the cutting operation and to make the opposing side surfaces of each wafer flat and parallel. Upon completion of the lapping operation, the wafers are subjected to a chemical etching operation to reduce further the thickness of the wafer and remove mechanical damage produced in the prior processing operations. At least one surface of the wafer may then be polished (both surfaces of each wafer may also be double-side polished) to improve wafer flatness and remove previous wafer damage. Even with such a damage-free surface, however, the wafer may not meet production specifications because it exhibits an unacceptable amount of waviness.

As the features included in integrated circuits become smaller, global nanotopography of silicon wafers becomes even more important. Waviness is one type of nanotopography feature observed in polished wafers. Typically, the direction of this waviness feature corresponds with the cutting direction of the cutting wire. Waviness is an unwanted artifact of wiresaw cutting that often survives downstream processing. Such wafer waviness exists at wavelengths across a spectrum, from large to small. Previous work related to the influence of the slicing process on wafer nanotopography focused on warp, such as site warp, or local warp, within particular wafer sites (e.g., U.S. Pat. No. 6,057,170). Such site specific measurement and analysis focuses on small wavelength warp and does not capture longer wavelength warp, such as those from about 50 millimeters (2.0 inches) to about 80 millimeters (3.1 inches) in length, which are defined as waviness herein. Focusing on site warp does not provide a comprehensive waviness solution because it does not take into account the free shape of the wafer. In contrast, waviness is directly related to the free shape of the wafer because it comprises the medium wavelength surface features of as-cut wafers. These medium wavelength features are between about 50 millimeters (2.0 inches) and about 80 millimeters (3.1 inches) on a 200 millimeter (7.9 inch) diameter wafer. For the present invention, such waviness is defined in the cutting direction, because waviness occurs primarily in that direction. The methodology, however, is more generally applicable to analysis in any direction where waviness is exhibited (e.g., waviness developed by other processing steps).

Recently, a number of new measurement tools have become available that are capable of capturing post-polish profiles of wafers as nanotopography features (e.g., WIS CR83-SQM®, available from ADE Corporation of Westwood, Mass., U.S.A., NanoMapper®, available from ADE Corporation and Magic Mirror™ available from HOLOGENiX of Huntington Beach, Calif., U.S.A.). Because these instruments use optical principles for surface characterization, they are capable of recognizing nanotopography features, but are incapable of identifying waviness of rough, as-cut wafers.

As-cut wafers, those wafers that are sliced from the ingot but not yet polished, that exhibit waviness may ultimately polish into either an acceptable wafer shape or an unacceptable wafer shape. There is no method, however, capable of predicting which wafers will polish into an acceptable shape and which will not. Because the steps between wafer cutting and polishing are time-consuming and costly, a method that could predict whether an as-cut wafer would include waviness after polishing would allow for selective polishing of wafers, thereby saving the expense of polishing wafers that would not ultimately produce a desired result. The method of the present invention achieves such a result.

SUMMARY OF THE INVENTION

Among the several objects of this invention may be noted the provision of such a method that estimates the post-polishing waviness of a wafer from data gathered in an as-cut condition; the provision of such a methodology that speeds the reaction time to identify a poorly performing wafer cutting process; the provision of such a methodology that identifies potentially problematic wafers for removal from the production stream before lapping and polishing; the provision of such a methodology that is proactive by actively seeking to identify problematic wafers earlier in the wafer production process; and the provision of such a methodology that creates a bright-line specification for predicting unacceptable waviness.

A method for estimating the post-polish waviness of an as-cut semiconductor wafer comprises measuring a thickness profile of an upper surface of a semiconductor wafer along an angle of the wafer and measuring a thickness profile of a lower surface of the wafer along the angle. A median surface profile of the wafer is constructed from the measurements. A band-pass filter is applied to the median surface profile to form a filtered median surface profile. A warp measurement of the filtered median surface profile is compared to a specification selected to estimate post-polish waviness.

In another embodiment, a method of producing wafers cut from stock material which are capable of meeting a predetermined flatness specification after further processing of the wafers is disclosed. The method comprises cutting the stock material to form multiple wafers and measuring at least one of the wafers to establish a surface profile of the wafer. The surface profile is filtered to produce a filtered surface profile which eliminates at least some of the features of the surface profile. The maximum deviation of the filtered surface profile is determined and compared against a maximum deviation standard. Only those wafers which have a maximum deviation less than the maximum deviation standard are processed further.

Other objects and features will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Generally, the present method is adapted to efficiently determine if a wafer cutting saw is slicing wafers that will later exhibit unacceptable waviness, as defined herein, after polishing. An early determination of wafer quality, specifically the identification of a wafer with an unacceptable amount of waviness, is important to semiconductor wafer production because it allows for removal of defect wafers from the production system before they are lapped, etched and polished at substantial cost, only then to exhibit an unacceptable waviness. Moreover, early identification of poorly cut wafers allows for timely correction of the cutting process.

Figure 1:
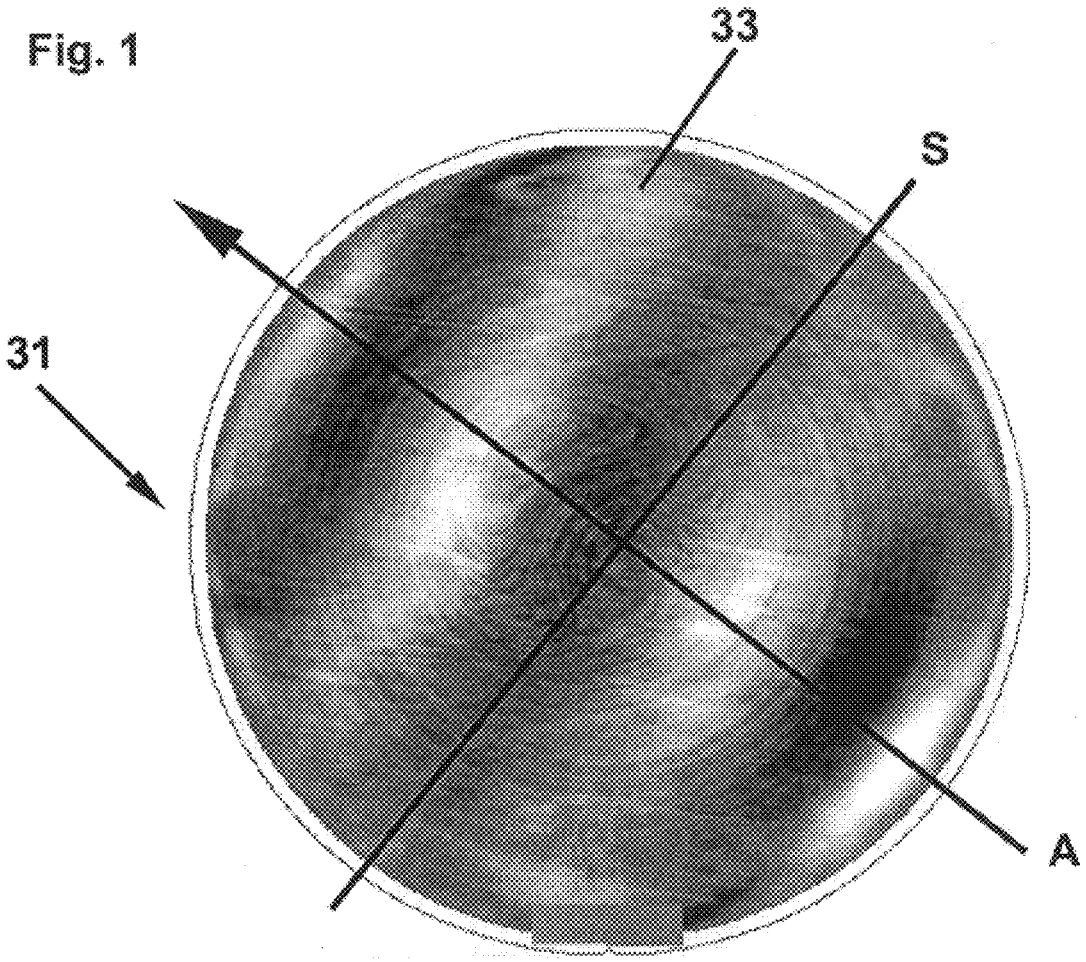
FIG. 1 is a relief map of a semiconductor wafer indicating a waviness defect.

When reviewing polished wafers, a distinct pattern emerges where wafers exhibit improper waviness. As shown in FIG. 1, wafer images gathered from a WIS CR83-SQM® wafer inspection machine show periodic banded patterns caused by the wiresaw cutting process. Polished wafers exhibiting such waviness at one surface will typically exhibit waviness at the other surface and throughout the depth of the wafer. As the cutting wire and slurry pass through a semiconductor ingot during cutting, wafers are cut from the ingot. The dynamics of the wire cutting process may cause waviness in the cut wafer surface, producing a wavy wafer surface in the direction of cutting. Such waviness, as defined herein, is undesirable because it may lead to wafers exhibiting unacceptable surface undulations after polishing, leading to potential problems when the wafer is divided into smaller portions for photolithography.

After wafer cutting, multiple downstream processes (e.g., lapping and polishing) affect the shape of the wafer and are capable of eliminating some short wavelength surface components, such as roughness. Other longer wavelength surface components survive, however, at least partly, beyond such downstream processes. The present method and system define a useful waviness definition and predict whether a wafer will likely exhibit waviness after such processing, based upon an accurate measurement of the wafer in an as-cut condition, before polishing. The method involves measuring the thickness of wafers, using an ADE 9500 UltraGage®, available from ADE Corporation of Westwood, Mass., U.S.A., and using such measurements to construct free surface profiles and a median surface profile of the wafer in the direction of wiresaw cutting. The median surface profile, as defined herein, is then passed through a particular Gaussian filter, which removes surface wavelengths unrelated to waviness, thereby delivering a filtered median surface profile indicative of potential waviness in a post-polished stage.

Figure 1A:
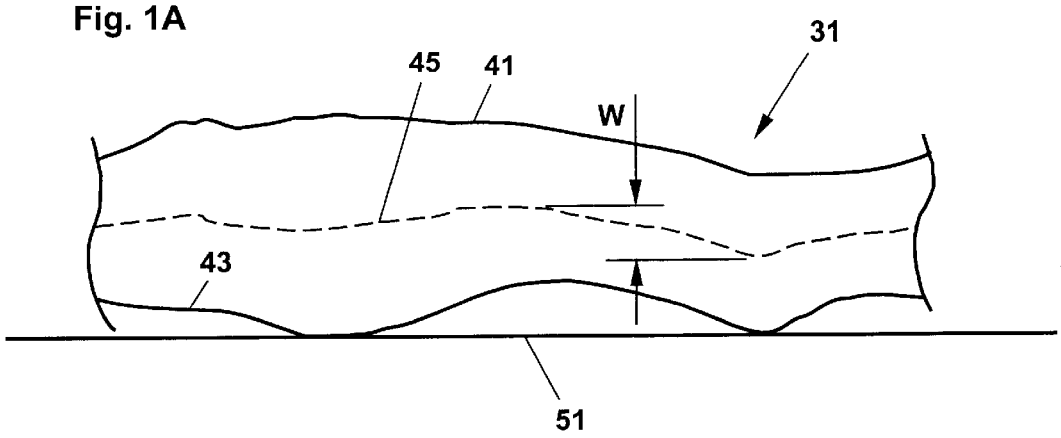
FIG. 1A is a schematic of a fragmentary cross section of a semiconductor wafer.

Warp and waviness, as defined herein, determine the free shape of the wafer. A wafer, such as the wafer shown in FIG. 1, generally indicated 31, includes an upper face 33 and a lower face (not shown). The faces may include unwanted undulations, denoted by the repeating pattern of light and dark bands. Such a pattern indicates that the wafer 31 face is exhibiting a significant degree of unevenness at regular intervals. Arrow A indicates the direction of slicing of the wafer 31 while line S indicates the orientation of the wire with respect to the wafer. The surfaces discussed herein are discrete surface profiles formed by the intersection of the faces of a wafer 31 with a plane passing through the wafer parallel to the slicing direction. Portions of such surfaces are depicted in the schematic of FIG. 1A. Here, a plane perpendicular to the wafer face and passing through line A would intersect the upper face 33 at an upper surface profile 41 and the lower face at a lower surface profile 43. For instance, such a plane would be coextensive with the page including FIG. 1A. Reviewing such upper and lower surface profiles 41, 43 provides valuable information regarding wafer 31 waviness, as defined herein.

Referring again to FIG. 1A, in addition to an upper surface profile 41 and a lower surface profile 43, the wafer 31 includes a median surface profile 45 defined as the series of points midway between the upper surface profile and the lower surface profile at each point along the median surface profile. In other words, the median surface profile 45 is midway between the upper surface profile 41 and lower surface profile 43 at each point along its length. The warp W of such a wafer 31 is defined as the difference between the maximum deviation and the minimum deviation of its median surface profile 45 measured relative to a reference plane 51. In other words, warp W is defined as the maximum vertical distance between the highest peak and lowest trough of the median surface profile 45. Because wafers 31 are somewhat resiliently deformable, such measurements must be undertaken with the wafer in a nearly unclamped ("free") state, or the measurements may be incorrect. The reference plane may be a "least square best-fit plane" for the median surface profile, but is preferably constructed by triangulation of three points on the supported back surface ("3-point plane"), as shown in FIG. 1A and as would be understood by one skilled in the art. A warp map, shown in FIGS. 8–11 and discussed below, is simply the mapping of a median surface profile with respect to the designated reference plane.

Current measurement techniques do not produce an upper surface profile, lower surface profile or a median surface profile as described above. Rather, specific points on the upper surface and lower surface of the wafer 31 are readily collected and identified by a measuring device, such as an ADE 9500 UltraGage®, as one skilled in the art would readily appreciate. By comparing such points to the reference plane, the upper surface profile and lower surface profile are readily constructed. By comparing the relative position of each pair of points on the upper and lower surfaces and plotting a point midway between such surface points, a median surface profile is readily defined midway between such points. The benefit of constructing such profiles will be described below.

The waviness of a wafer is defined differently, based upon the surface topology of the wafer formed during the wirecutting, or wiresawing, process. Waviness is defined as the deviation of the median surface profile, taken in the direction of slicing, from the three point median reference plane, but only after long wavelength waves and short wavelength waves are removed from the median surface profile, as discussed in detail below. In other words, the waviness of a wafer is dependent upon the deviation of a filtered median surface profile, rather than from the warp of an unfiltered median surface profile.

After wafer cutting, multiple downstream processes affect the shape of the wafer. These downstream processes, such as lapping and polishing, are capable of eliminating low wavelength surface components, such as roughness, whereas medium and high wavelength components survive, at least partly, beyond such downstream processes. If the amplitudes of these remaining medium and high wavelength components are large, as will be defined below, they may create high values of site-warp and unacceptable waviness in nanotopography maps.

Amongst all the downstream processes, lapping is the only process that reduces as-cut wafer warp to any appreciable extent. Lapping reduces both the thickness of the wafer and its total thickness variation (TTV), which is defined as the difference between the maximum thickness and minimum thickness of the wafer. Because the TTV of a wafer may partially contribute to its warp, any reduction in TTV may include at least a partial reduction in warp.

Figure 6:
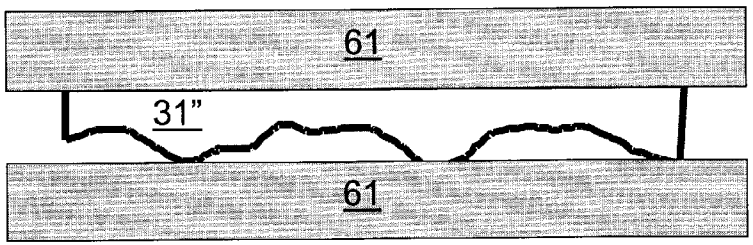
FIG. 6 is a schematic of the wafer of FIG. 5 shown between two lapping platens.
Figure 2:
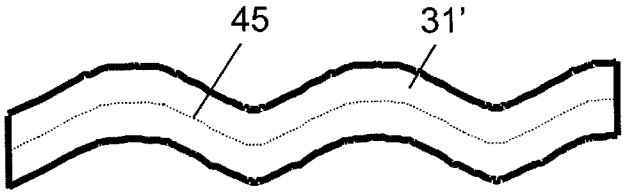
FIG. 2 is a schematic cross section of a semiconductor wafer having a uniform thickness.
Figure 3:
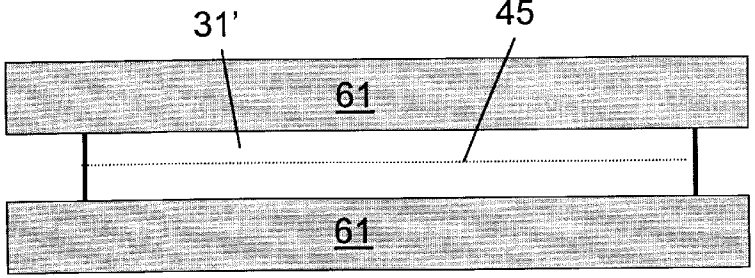
FIG. 3 is a schematic of the wafer of FIG. 2 shown between two lapping platens.

Although lapping may partially reduce the warp of an as-cut wafer 31, waviness is marginally reduced by increased lapping. Lapping and polishing processes coin, or press, the wafers between two platens 61, as shown in FIGS. 3 and 6. These platens 61 act upon the thickness distribution of the wafers 31, attempting to make them more uniform. For example, when a wafer 31' with a low TTV (FIG. 2) is pressed between the platens 61 (FIG. 3), its long wavelength components are elastically pressed out. Small wavelength components, however, are not pressed out. As the working pressure of the platens 61 increases, the amplitude of the non-ironed out wavelengths become shorter and shorter. High frequency, small wavelength, components, typically defined as wafer roughness, are removed by such processing. When the process ends and the working pressure of the platens 61 is removed (FIG. 4), the elastically ironed out wavelength components partially spring-back to their original position. Overall, therefore, assuming that further downstream processing has no effect on waviness, portions of the medium and large wavelength components of the wafer median surface profile survive most of the downstream processes.

Figure 5:
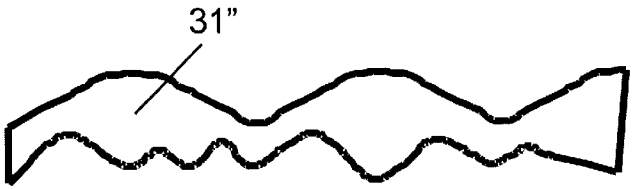
FIG. 5 is a schematic cross section of a semiconductor wafer having a non-uniform thickness.
Figure 7:
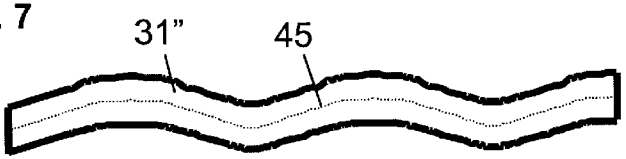
FIG. 7 is a schematic of the wafer of FIG. 5 after lapping.

FIGS. 5–7 depict the same lapping process for a wafer 31" with a high TTV. As with the low TTV wafer 31', lapping removes wafer roughness formed by high frequency, small wavelength, components, leaving the medium and large wavelength components (FIG. 7). The wafers 31 depicted in FIGS. 4 and 7 have similar shapes, demonstrating that because lapping only removes small wavelength waviness, wafers, regardless of their TTV, will exhibit medium and long wavelength components after lapping.

Figure 8:
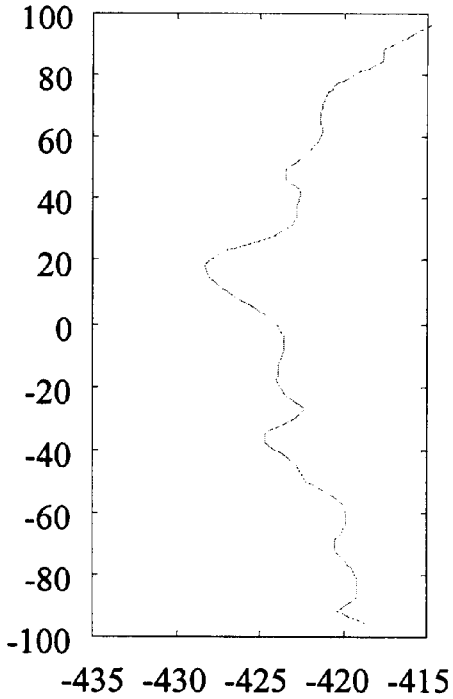
FIG. 8 is an upper surface profile of a representative as-cut wafer.
Figure 9:
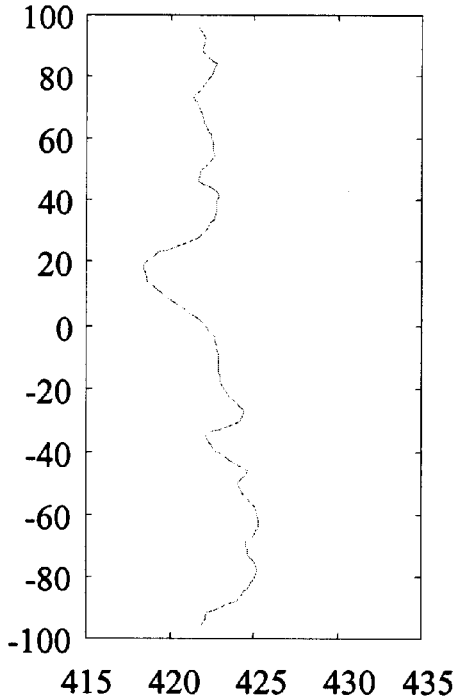
FIG. 9 is a lower surface profile of the wafer of FIG. 8.
Figure 10:
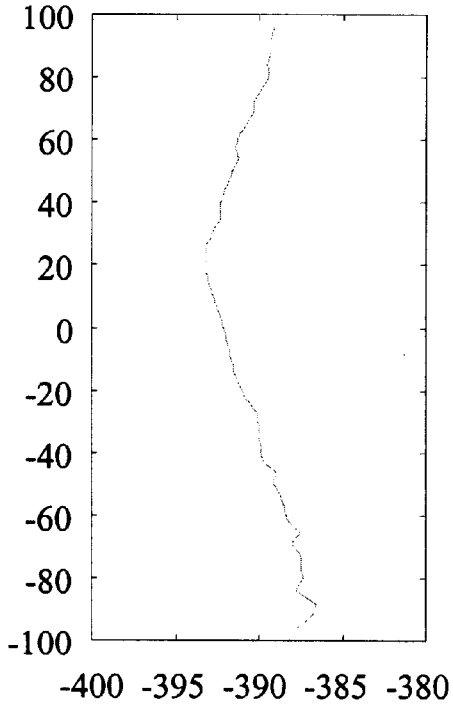
FIG. 10 is an upper surface profile of the wafer of FIG. 8 after lapping.
Figure 11:
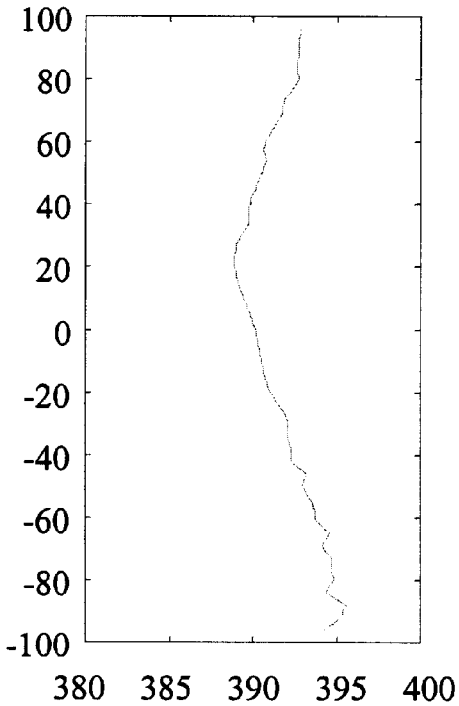
FIG. 11 is a lower surface profile of the wafer of FIG. 10.

As a further example, FIGS. 8–11 depict the actual free surface of the wafer 31" from FIGS. 5–7 before and after lapping. The vertical axis of each chart indicates position along the wafer 31 in millimeters while the horizontal axis indicates wafer thickness in microns. As is shown by the figures, small wavelength features of the as-cut wafer are clearly evident in FIGS. 8 and 9. Such features are characterized by short, yet noticeable, fluctuations in the profile. However, after lapping, the same wafers 31 exhibit only long and medium wavelength components (FIGS. 10 and 11). Most of the small wavelength features shown in FIGS. 8 and 9 are nearly indistinguishable in FIGS. 10 and 11. Although lapping effectively removes these features (e.g., wire-marks) from the as-cut surface, it introduces its own abrasion damage, requiring further polishing to create a more defect-free surface.

Figure 4:
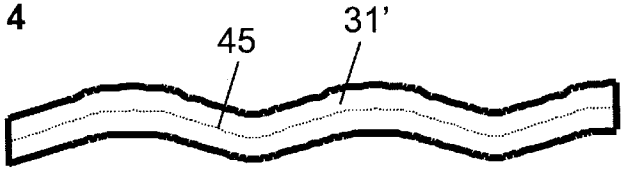
FIG. 4 is a schematic of the wafer of FIG. 2 after lapping.

In order to estimate the post-polish attributes of a particular wafer, at least one of the wafer profiles must be filtered to simulate further wafer processing. It is contemplated within the scope of the present invention that the surface used for the filtration calculation may be varied, although the median surface profile is preferred. Filtering an as-cut wafer with a filter based upon the top surface, bottom surface or median surface profile would produce three different waviness measurements. Utilizing the median surface profile is preferred, however, because after lapping the TTV of the wafer is small, such that the wafer free surfaces become substantially symmetric about the median surface profile, as shown in FIGS. 4 and 7.

Waviness is a component of as-cut warp, in the slicing direction, that survives downstream processing. The as-cut warp of a wafer in the slicing direction can be decomposed into a number of components, depending on their wavelengths. The small wavelength (i.e., large frequency) components create roughness, the large wavelength components are responsible for the shape of the wafer and the medium wavelength components create the waviness defect. Waviness is a defect seen on post-polished wafers when inspected under nanotopography measuring tools. In nanotopography measurements, similar to warp, the wafers are in a nearly unclamped state. The waviness almost exclusively occurs in the slicing direction and has a wavelength of about 60 millimeters (2.4 inches). Thus, the wavelengths of interest are between about 50 millimeters (2.0 inches) and about 80 millimeters (3.1 inches), yielding approximately three to four waves over a single 200 millimeter (7.9 inch) wafer. Close examination of as-cut warp and thickness maps for a wafer with heavy post-polished waviness typically indicate a pre-polishing warp with substantial similarity to the post-polishing waviness. This further supports the conclusion that waviness is merely a portion of as-cut warp that survives downstream processing. The claimed invention is readily applicable to wafers of various diameters, such as 300 millimeter (12 inch) and 150 millimeter (5.9 inch) wafers. The appropriate medium wavelength features would change as the diameter of the wafer changes, as would be appreciated by one skilled in the art.

A wafer surface profile may be composed of a range of frequency components. Although these frequencies may be divided in any number of ways, the present invention divides the frequencies into three groups. A high frequency group includes all low wavelength components and corresponds to "roughness" of the wafer. A low frequency group includes all high wavelength components and corresponds to the overall "shape" of the wafer. A medium frequency group corresponds to medium wavelength components and corresponds to wafer "waviness. " The present invention decomposes the wafer profile by removing smaller and larger wavelength variations, to reveal the existence of only the medium length wavelengths that may survive the lapping process to create a wafer having unacceptable waviness. The roughness is filtered out to mimic processing, while the shape is filtered out because such wavelengths are typically too long to have an impact on a portion of the wafer intended for a chip.

Figure 14:
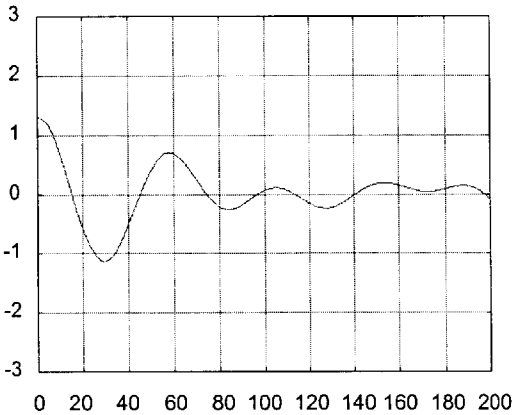
FIG. 14 is the wafer median profile chart of FIG. 12 filtered to capture wavelengths between about 50 millimeters (2.0 inches) and about 80 millimeters (3.1 inches)
Figure 12:
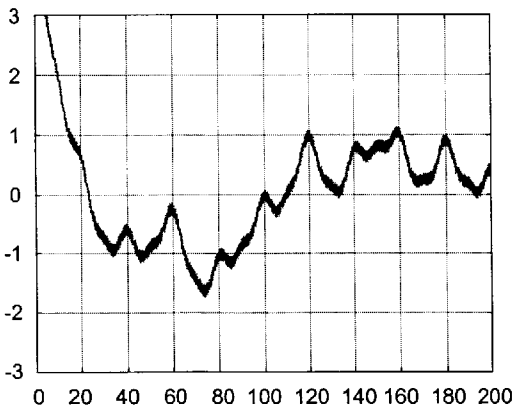
FIG. 12 is a chart of a mathematically engineered wafer median profile taken in the slicing direction.
Figure 13:
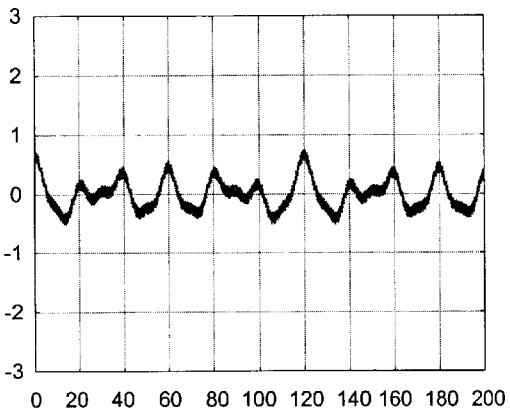
FIG. 13 is the wafer median profile chart of FIG. 12 filtered to capture wavelengths between about 0.1 millimeter (0.004 inch) and about 40 millimeters (1.6 inches)
Figure 15:
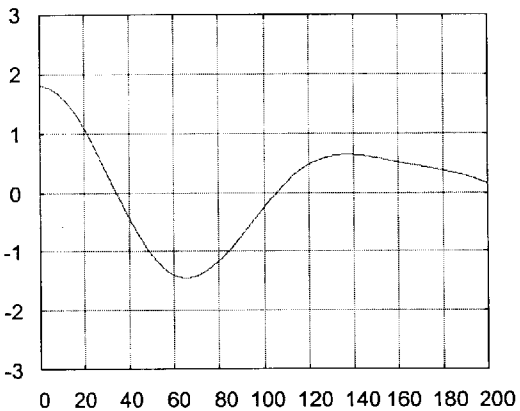
FIG. 15 is the wafer median profile chart of FIG. 12 filtered to capture wavelengths between about 90 millimeters (3.5 inches) and about 200 millimeters (7.9 inches)

FIGS. 12–15 show schematically the roles of different wavelength components on the median surface profile in the cutting direction. The vertical axis of each chart indicates wafer thickness in microns while the horizontal axis indicates position along the wafer in millimeters. FIG. 12 indicates the summation of all wavelength components, such as would be present on an as-cut, unfiltered profile. FIG. 13 shows the wafer median surface profile chart of FIG. 12 filtered to exclude all but short wavelengths between about 0.1 millimeter (0.004 inch) and about 40 millimeters (1.6 inches). These small wavelengths correspond to wafer roughness. FIG. 14 shows the wafer median surface profile chart of FIG. 12 filtered to exclude all but medium wavelengths between about 50 millimeters (2.0 inches) and about 80 millimeters (3.1 inches). These medium wavelengths correspond to any waviness defect in the cutting direction. Finally, FIG. 15 shows the wafer median surface profile chart of FIG. 12 filtered to exclude all but large wavelengths between about 90 millimeters (3.5 inches) and about 200 millimeters (7.9 inches). These large wavelengths correspond to the overall shape of the wafer in the cutting direction.

Once frequency groupings are established, a filtering scheme may be employed that separates such frequency groups from one another. For instance, filtering allows for separation of the different frequency groupings of a surface profile. Depending upon what frequency component is desired, the filtering operation may be classified as high-pass (short-pass), low-pass (long-pass) or band-pass. High-pass filtering allows only short wavelength (high frequency) components through, thus producing a roughness representation. In contrast, low-pass filtering allows only long wavelength (low frequency) components through, thus capturing the shape of the wafer. Finally, band-pass filtering extracts a profile of a specified band-width by applying a high-pass and a low-pass filter, producing a controlled set of data within a particular band-width. The cutoff of a particular filter specifies the frequency bound below or above which the components are extracted or eliminated.

As stated previously, filtering the median surface profile of an as-cut wafer to predict whether the wafer will exhibit pronounced waviness after polishing is the focus of the present invention. Consequently, the filter used must be phase-conserving, so that the position of a peak in the filtered surface profile will exactly coincide with the position of the corresponding peak in the actual profile. In one embodiment of the present invention, a phase-conserving Gaussian filter is selected because it provides such correspondence, as discussed in greater detail in the next section. Other filters are contemplated as within the scope of the present invention (e.g., 2RC filters (analog as well as digital), Triangle filters and RK filters), although Gaussian filters are preferred due to their phase-conserving properties.

Figure 16:
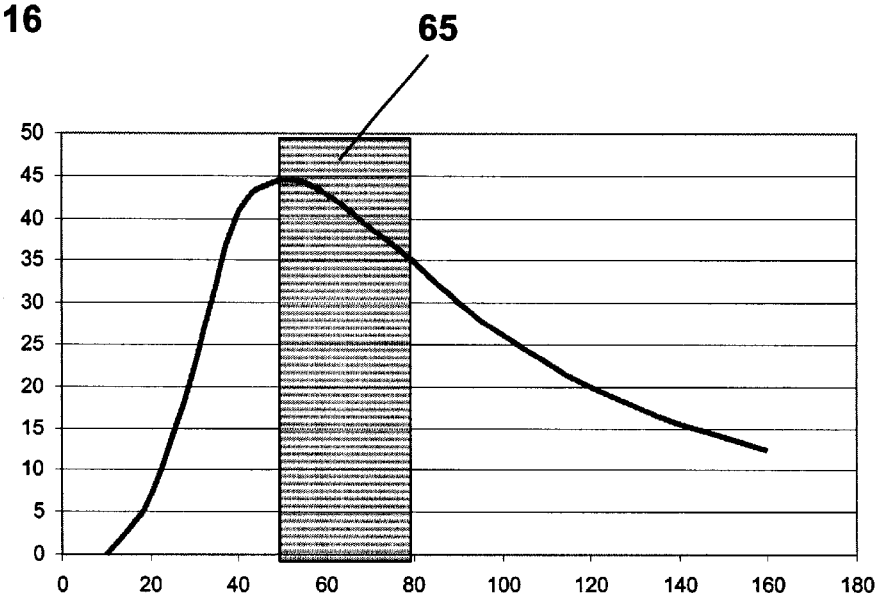
FIG. 16 is a graph depicting the frequency response of a band-pass filter.

For the present invention, a phase-conserving Gaussian band-pass filter was employed to separate the profile into its components. The filter used the following weighting functions in Fourier Domain:

$F(\lambda)=\exp(-0.6932\ (\lambda_c/\lambda)^2)$, corresponding to the high-pass filter, and $F(\lambda)=1-\exp(-0.6932\ (\lambda_c/\lambda)^2)$, corresponding to the low-pass filter.

Where $\lambda_c$ represents the desired wavelength cutoff for each filter, respectively, and the coefficients −0.6932 in both equations represent a cutoff at one standard deviation from the mean, $\lambda$ representing an arbitrary wavelength. Moreover, the phase-conserving Gaussian band-pass filter uses a cutoff of about 50 millimeters (2.0 inches) for the high-pass filter and a cutoff of about 80 millimeters (3.1 inches) for the low-pass filter. An example of the frequency response of such a filter is shown in FIG. 16 for a wavelength band 65 from about 50 millimeters (2.0 inches) to about 80 millimeters (3.1 inches). The vertical axis of the chart indicates the percent of signals transmitted while the horizontal axis indicates wavelength in millimeters. The Gaussian filter is preferred because it is phase-conserving. Other phase-conserving filters are also contemplated as within the scope of the present invention.

In order for the present method to predict the likely polishing outcome of an as-cut wafer, a specification for as-cut waviness must be established. This specification may then be used as a gage by which wafers may be quickly judged, as-cut and promptly after slicing, so that any wafers with waviness problems that will survive additional processing can be detected after cutting, but before additional processing. Such a specification will allow for corrective action, such as removal of the wafer from the production process without the additional expense of polishing the wafer.

Experiments were undertaken to create a waviness specification for as-cut wafers that would predict whether a given wafer would produce excessive waviness after polishing. First, a standard must be selected that corresponds to an acceptable waviness specification in post-polished wafers. Although any standard may be selected as a starting point, the post-polishing wafer standard used to create the as-cut specification states that polished wafers, to be considered acceptable, must exhibit no waviness having an amplitude greater than or less than about 20 nanometers (0.79 microinch). Stated differently, a nano-mapper measuring at a +/−20 nanometer (0.79 microinch) amplitude resolution will not detect any waviness in an acceptable wafer. Such a resolution standard separates wafers exhibiting unacceptable waviness levels from those exhibiting acceptable levels of waviness. Other resolution standards are also contemplated as within the scope of the present invention.

In reviewing the as-cut wafer data from the wafers noted above, the warp of each wafer is measured and recorded. These as-cut median surface profiles are then processed by passing each through the Gaussian filter described above. After filtering, the warp of each median surface profile is measured again. The results of such measurements will vary depending upon the cutting process used.

Next, the same wafers are lapped, polished and measured again, such that post-polish median surface profiles could be constructed for each wafer. For comparison, the warp of each wafer is then measured using a nano-mapper after polishing, to see which wafers satisfy the selected standard, namely, exhibiting no waviness when measuring the wafer at about a +/−20 nanometer (0.79 microinch) resolution. All wafers not exhibiting waviness at the +/−20 nanometer (0.79 microinch) resolution are considered acceptable, or good, wafers. Those lapped and polished wafers exhibiting a waviness at the +/−20 nanometer (0.79 microinch) resolution are considered unacceptable, or bad, wafers.

Once the wafers are grouped as being good or bad, the filtered warp values of the bad wafers are reviewed to see what level of warp indicates a potentially bad wafer. For the testing associated with these wafers, the maximum, filtered, as-cut warp specification value that consistently yields a good wafer is about 1.00 micron (39.4 microinches). To ensure a good wafer, the warp of the filtered, as-cut median surface profile along the cutting direction should be less than about 1.00 micron (39.4 microinches) in the line span of 160 millimeters (6.3 inches) after being subject to about a 50–80 millimeter (2.0–3.1 inch) bandwidth Gaussian filter. Put simply, a wafer with a filtered profile having a measured warp less than the specification will likely not exhibit waviness after lapping and polishing. In a preferred embodiment, the amplitude of the filtered median surface profile should be less than about 0.80 micron (31 microinches).

This specification is applied to the profile after the Gaussian filter has filtered the original profile, but without additional wafer processing. This specification may be further refined and adjusted depending upon further testing of wafers and changes in wafer processing. It is important to note that this specification value is system dependent and would likely be different on any system. Different cutting, lapping, polishing and cleaning processes, among other things, can affect these values. Other processing facilities, even on similar machines, will likely yield different specification results. Despite these system dependent limitations, the methodology set forth above and used to develop such a specification may be adapted to any system.

Figure 17:
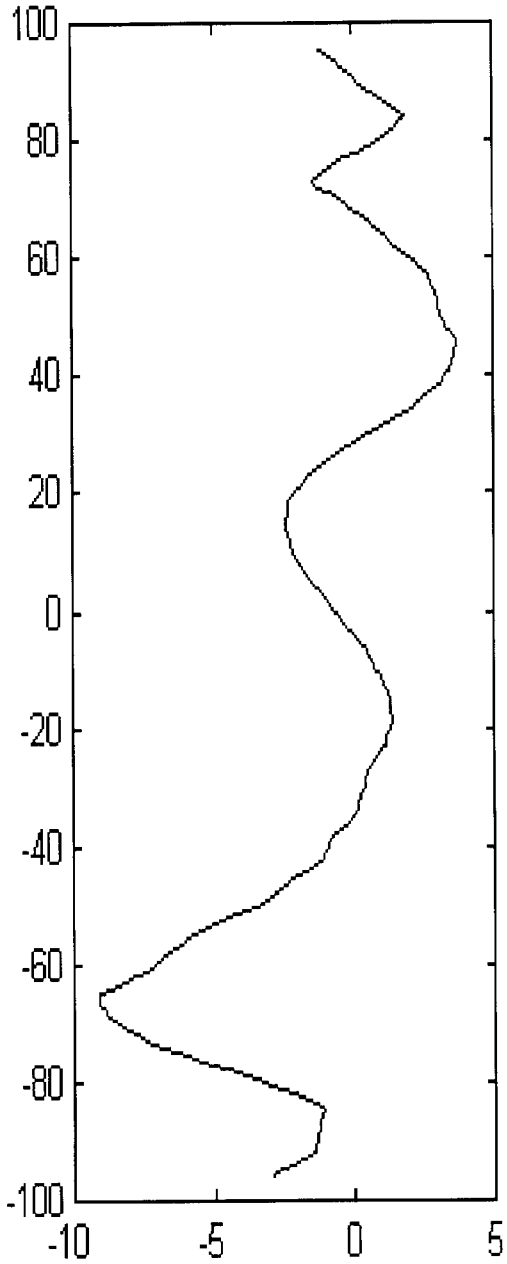
FIG. 17 is a graph of a median surface profile of an as-cut wafer.
Figure 18:
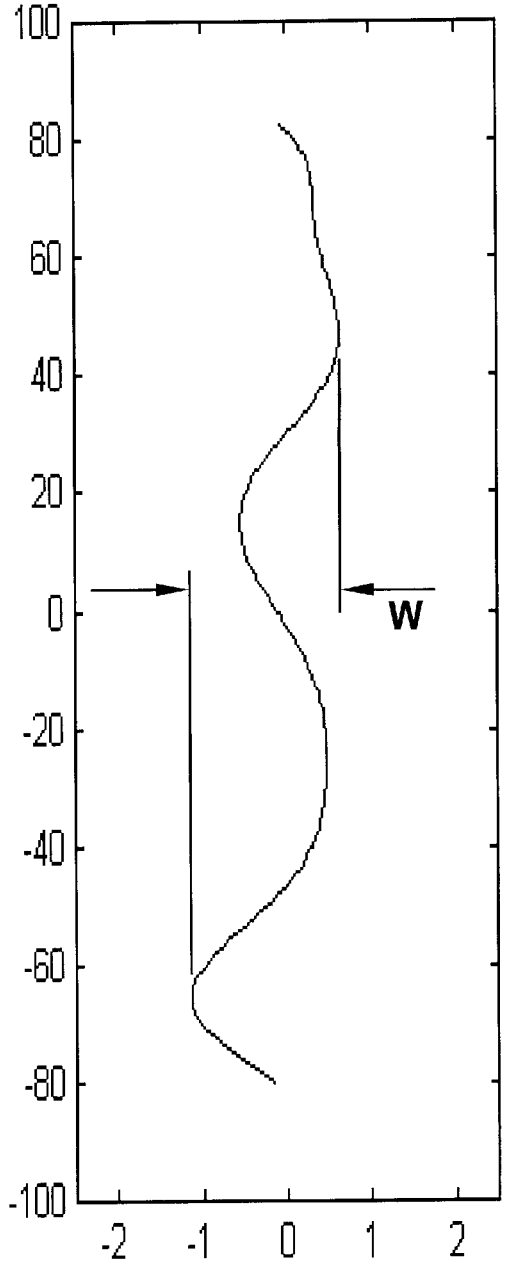
FIG. 18 is a graph of a filtered median surface profile of the wafer of claim 2 demonstrating a wafer in violation of the waviness specification.
Figure 19:
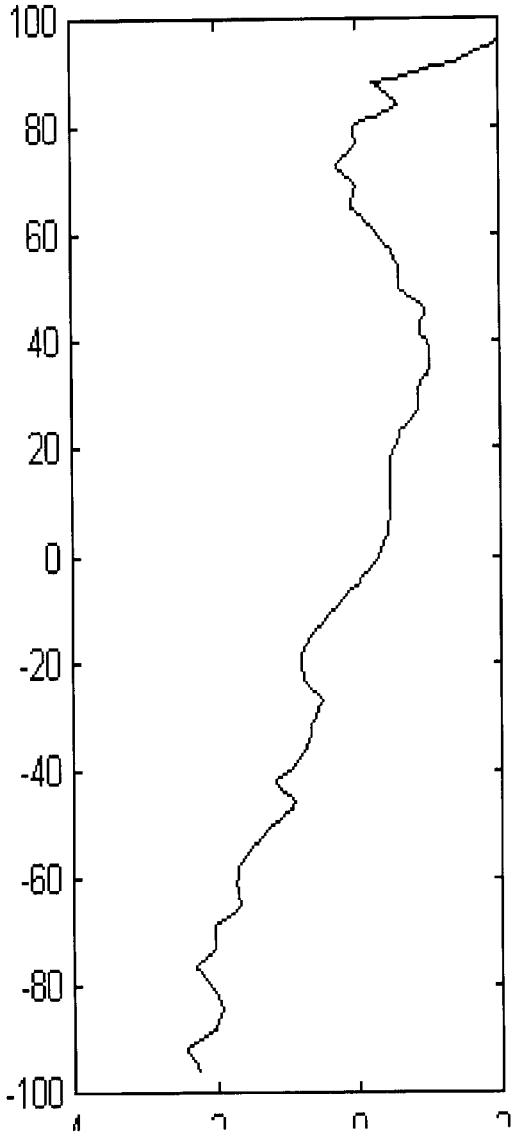
FIG. 19 is a graph of a median surface profile of an as-cut wafer.
Figure 20:
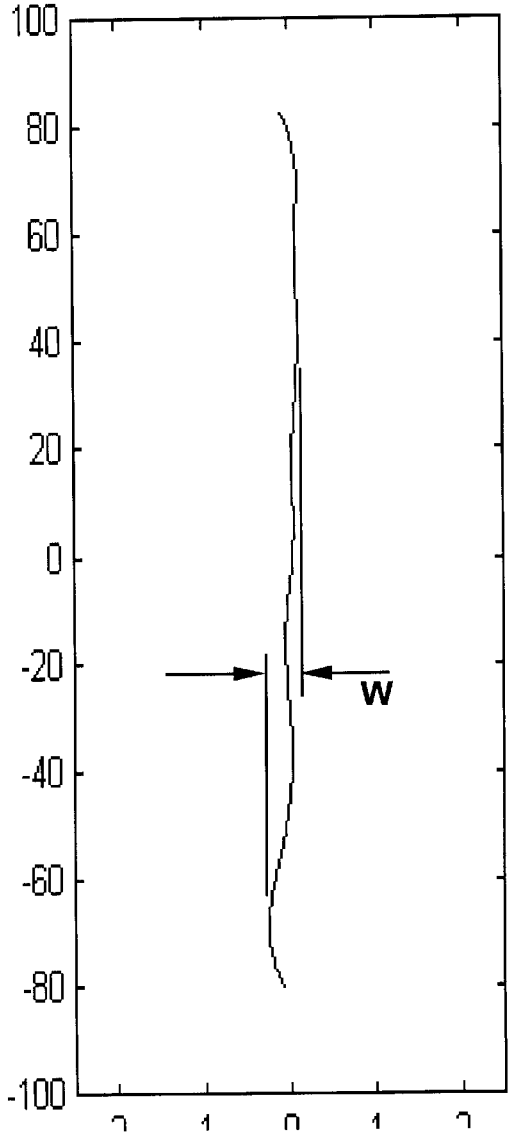
FIG. 20 is a graph of a filtered median surface profile of the wafer of claim 4 demonstrating a wafer meeting the waviness specification.

For example, FIGS. 17 and 18 depict an as-cut median surface profile and a filtered median surface profile for a wafer not meeting the specification noted above. The vertical axis of each chart indicates position along the wafer 31 in millimeters while the horizontal axis indicates wafer thickness in microns. Here, the warp W is approximately 1.6 microns (63 microinches), or greater than the specification. Such a wafer would not need to be processed further, as the filtered warp W of the median surface profile indicates that the wafer will likely exhibit unacceptable waviness after polishing. Alternately, FIGS. 19 and 20 depict an as-cut median surface profile and a filtered median surface profile for a different wafer that meets the specification noted above. The vertical axis of each chart indicates position along the wafer 31 in millimeters while the horizontal axis indicates wafer thickness in microns. The warp W of this wafer is approximately 0.6 microns (24 microinches), or less than the specification. In the absence of other defects with the wafer, such a wafer would preferably be processed further because the filtered warp W of the median surface profile indicates that the wafer will likely exhibit acceptable waviness after polishing.

The present analysis is concerned solely with slicing direction waviness. Issues such as taper of the wafer are not considered here so that the application may focus more closely on the issue of waviness.

In view of the above, it will be seen that the several objects of the invention are achieved and other advantageous results attained.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A method of producing wafers cut from stock material which are capable of meeting a predetermined flatness specification after further processing of the wafers, the method comprising:

a) measuring at least one of the wafers to establish a surface profile of the wafer;

b) filtering the surface profile to produce a filtered surface profile which eliminates at least some of the features of the surface profile;

c) determining a warp measurement of the filtered surface profile;

d) comparing the warp measurement with a specification selected to estimate post-polish waviness; and e) further processing only those wafers which have a warp measurement less than the specification.

2. A method as set forth in claim 1 wherein said measuring to establish a surface profile of the wafer comprises measuring a thickness profile of an upper surface of a wafer along an angle of said wafer, measuring a thickness profile of a lower surface of said wafer along said angle and constructing a median surface profile of said wafer from said measurements.

3. A method as set forth in claim 2 wherein said constructing comprises constructing said median surface profile midway between the thickness profile of the upper surface and the thickness profile of the lower surface at each point along their lengths.

4. A method as set forth in claim 2 wherein the comparing comprises a specification of about 1.00 microns (39.4 microinches).

5. A method as set forth in claim 4 wherein the comparing comprises a specification of about 0.80 microns (31 microinches).

6. A method as set forth in claim 1 wherein the filtering comprises filtering to eliminate at least some of the small wavelength features of the surface profile.

7. A method as set forth in claim 1 further comprising cutting the stock material to form multiple wafers.

8. A method as set forth in claim 7 wherein the cutting comprises cutting with a wiresaw.

9. A method as set forth in claim 1 wherein the filtering to produce a filtered surface profile comprises applying a band-pass filter.

10. A method as set forth in claim 9 wherein the filtering comprises applying a phase-conserving filter.

11. A method as set forth in claim 10 wherein the filtering comprises applying a Gaussian filter.

12. A method as set forth in claim 11 wherein the filtering comprises filtering the surface profile with a cutoff of about 50 millimeters (2.0 inches) for a high-pass portion of the Gaussian filter and a cutoff of about 80 millimeters (3.1 inches) for a low-pass portion of the Gaussian filter.

13. A method as set forth in claim 12 wherein the comparing comprises a specification of about 1.00 microns (39.4 microinches).

14. A method as set forth in claim 13 wherein the comparing comprises a specification of about 0.80 microns (31 microinches).

* * * * *